US008550209B2

(12) United States Patent
Büssow et al.

(10) Patent No.: US 8,550,209 B2
(45) Date of Patent: Oct. 8, 2013

(54) MUFFLER FOR A TURBO OR PISTON ENGINE

(75) Inventors: Richard Büssow, Oberhausen (DE); Ralf Gödde, Kamen (DE); Udo Thiel, Gelsenkirchen (DE); Thomas Barwanietz, Oberhausen (DE); Daniela Joswig, Oberhausen (DE)

(73) Assignee: MAN Diesel & Turbo SE, Augsburg (DE)

( * ) Notice: Subject to any disclaimer, the term of this patent is extended or adjusted under 35 U.S.C. 154(b) by 0 days.

(21) Appl. No.: 13/201,681

(22) PCT Filed: Nov. 20, 2009

(86) PCT No.: PCT/DE2009/050064

§ 371 (c)(1),
(2), (4) Date: Nov. 16, 2011

(87) PCT Pub. No.: WO2010/091656

PCT Pub. Date: Aug. 19, 2010

(65) Prior Publication Data

US 2012/0048645 A1 Mar. 1, 2012

(30) Foreign Application Priority Data

Feb. 16, 2009 (DE) ..... 10 2009 009 168

(51) Int. Cl.
*F01N 1/08* (2006.01)
*F02M 35/12* (2006.01)

(52) U.S. Cl.
USPC ..... 181/229; 181/276

(58) Field of Classification Search
USPC ..... 181/229, 250, 266, 273, 276
See application file for complete search history.

(56) References Cited

U.S. PATENT DOCUMENTS

| | | | | |
|---|---|---|---|---|
| 2,157,030 | A * | 5/1939 | Starkweather et al. | 181/254 |
| 4,244,442 | A * | 1/1981 | Scarton et al. | 181/230 |
| 4,874,062 | A * | 10/1989 | Yanagida et al. | 181/250 |
| 4,880,078 | A * | 11/1989 | Inoue et al. | 181/232 |
| 5,183,976 | A * | 2/1993 | Plemons, Jr. | 181/264 |
| 5,365,025 | A * | 11/1994 | Kraai et al. | 181/249 |
| 5,507,159 | A * | 4/1996 | Cooksey | 62/503 |
| 5,783,780 | A * | 7/1998 | Watanabe et al. | 181/229 |
| 6,983,820 | B2 * | 1/2006 | Boast et al. | 181/249 |
| 7,448,469 | B2 * | 11/2008 | Seyler et al. | 181/249 |
| 2005/0284691 | A1 * | 12/2005 | Voss et al. | 181/255 |

FOREIGN PATENT DOCUMENTS

| | | | |
|---|---|---|---|
| FR | 2869949 | A1 * | 11/2005 |
| JP | 09242342 | A * | 9/1997 |

* cited by examiner

*Primary Examiner* — Jeremy Luks
(74) *Attorney, Agent, or Firm* — Cozen O'Connor

(57) ABSTRACT

A muffler for a turbo engine or piston engine, particular a screw compressor, includes a housing (1.1-1.3); a disk arrangement having at least one disk (3, 4, 5) which is fastened to the housing; a pipe arrangement which is fastened to the disk arrangement and which has at least one pipe (2.1, 2.2) for guiding a fluid of the turbo engine or piston engine; and a vibration-damping jacket (9) of dimensionally stable material which at least partially covers the outer side of the housing (2.2). At least one elastic element (3.3, 4.3, 6, 7, 8) is arranged between the pipe arrangement and the housing.

13 Claims, 1 Drawing Sheet

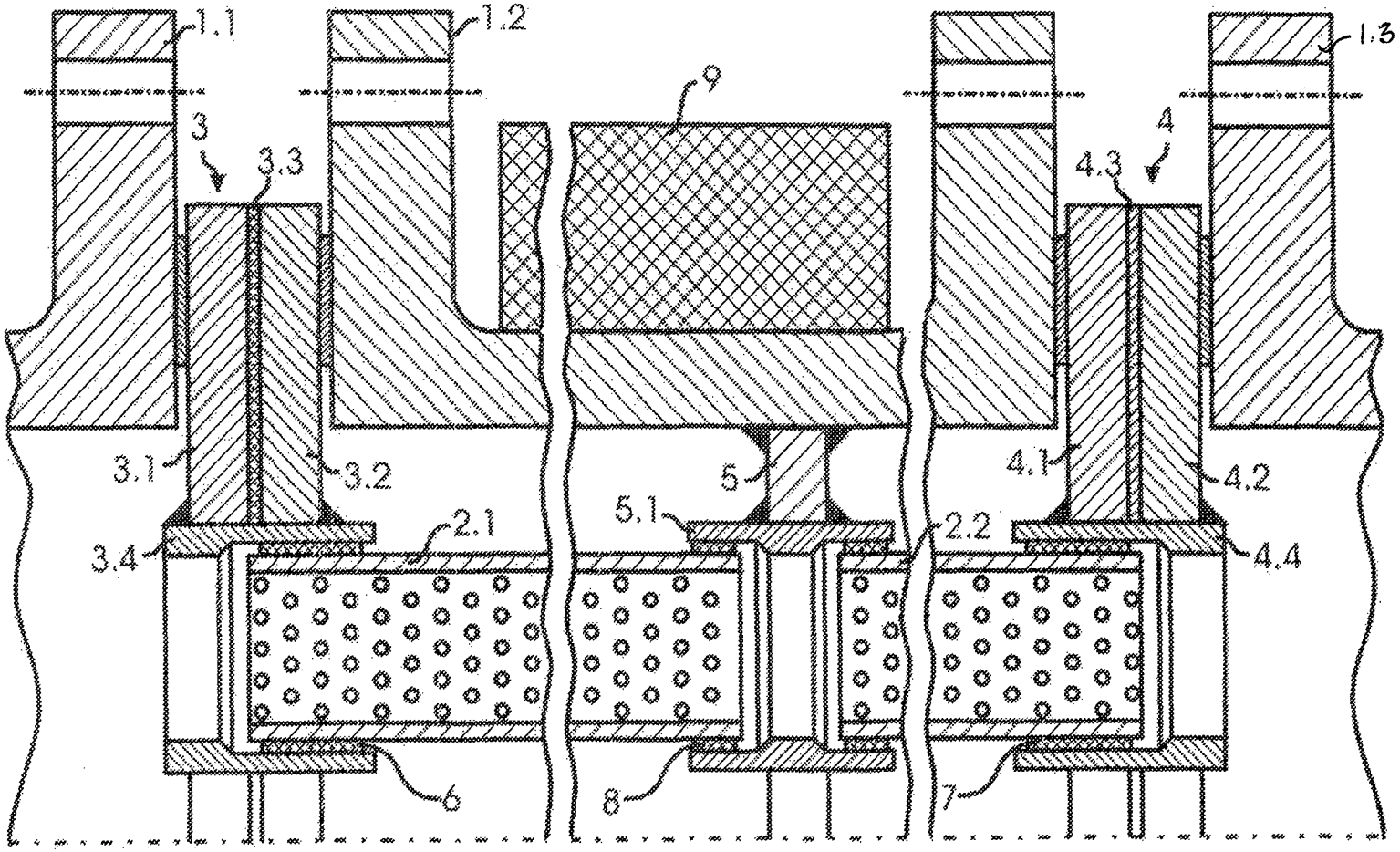
1.3
4
4.3
4.2
4.4
4.1
2.2
7
9
5
5.1
8
1.2
2.1
6
3.2
3.3
3
1.1
3.1
3.4

MUFFLER FOR A TURBO OR PISTON ENGINE

PRIORITY CLAIM

This is a U.S. national stage of application No. PCT/DE2009/050064, filed on 20 Nov. 2009. Priority is claimed on the following applications: Country: Germany, Application No.: 10 2009 009 168.8, Filed: 16 Feb. 2009, the content of which is incorporated here by reference.

BACKGROUND OF THE INVENTION

The invention is directed to a muffler for a turbo engine or piston engine, particular a screw compressor or screw expander, and a method for producing a muffler of this type.

During the operation of turbo engines and piston engines, there often occur vibrations which are characterized by periodic excitations of the machine, or the like, for example, due to pressure fluctuations in the fluid, and which lead to unwanted sound emission in particular. In order to reduce the transfer and emission of sound, it is known to arrange mufflers upstream and/or downstream of turbo engines and piston engines or stages thereof; the fluid flows through these mufflers so that the mufflers reduce pressure fluctuations in the fluid, generally in a dissipative manner.

For this purpose, a muffler for a turbo engine or piston engine, particular a screw compressor, having a housing, a disk arrangement having at least one disk which is fastened to the housing, and a pipe arrangement which is fastened to the disk arrangement and which has at least one pipe for guiding a fluid of the turbo engine or piston engine, in which fluid circulates around a central damper screen received in a housing is known from in-house practice. The housing is enclosed on its outer side by a sand jacket to reduce the transfer and emission of sound.

SUMMARY OF THE INVENTION

It is thus an object of the present invention to provide an improved muffler for a turbo engine or piston engine, particularly for a screw compressor.

This object is met through the further development of the above muffler as described herein.

On one hand, the present invention is based on the insight that the prior sand jacket does not damp vibrations of the housing in an optimal manner because the sand does not make uniform contact in all places due to the action of gravity. Therefore, in accordance with one aspect of the present invention, it is proposed that the housing is covered on its outer side by a vibration-damping jacket of dimensionally stable material so that a more uniform contact exists between the housing and jacket. The use of dimensionally stable material can also simplify the fastening of the jacket to the housing in an advantageous manner.

On the other hand, the present invention takes into account the insight that a substantial proportion of the structure-born sound in mufflers such as those used up to the present time in in-house practice takes place via the inner pipe in the relevant frequency ranges during operation so that damping the housing on its outer side by means of the sand jacket does not by itself reduce the transfer and emission of sound in an optimal manner. Therefore, according to another aspect of the present invention which can be combined in a particularly preferable manner with the jacket of dimensionally stable material mentioned above, it is proposed to arrange an elastic element between a pipe arrangement and the housing. In this way, the pipe arrangement can be partially decoupled with respect to vibration, and a transfer of structure-borne sound in particular can accordingly be reduced.

A muffler according to the invention is provided for a turbo engine and piston engine, particularly a compressor, and is used in a particularly advantageous manner in screw compressors which are subject to strong periodic vibration excitation due to their mechanism of operation. The muffler comprises a housing having one or preferably more parts, a pipe arrangement having one or preferably more pipes for guiding a fluid, e.g., a process gas, a liquid, or the like, of the turbo engine or piston engine, and a disk arrangement having one or preferably more disks which are fastened to the housing detachably, e.g., clamped in a frictional engagement by screws, or permanently, e.g., by welding, and support the pipes of the pipe arrangement. In particular, one or more disks can also be formed, at least in part, so as to be integral with the housing, e.g., by means of primary shaping or deformation.

According to a first aspect of the present invention, one or more elastic elements are arranged between the pipe arrangement and the housing to at least partially decouple the pipe arrangement from the housing with respect to vibrations. One or more, preferably all, of the elastic elements are preferably constructed so as to damp vibrations and, to this end, preferably have higher damping constants with respect to relevant frequency ranges. A higher damping constant can be characterized, for example, by a sufficiently large reduction in amplitude in the frequency response of the muffler in the range of relevant frequencies. In particular, an elastic element can comprise an elastomer, a thermoplastic or duroplast, or sealing materials which are also used for flange connections.

Resonant frequencies of the muffler and amplitude peaks in the frequency response thereof, i.e., the vibration response to excitations over the frequency of excitation, can be shifted by the vibration decoupling, and the transfer and emission of sound can accordingly be reduced. In addition, vibration energy can be dissipated by vibration-damping elements so that the transfer and emission of sound can be reduced even further.

In a preferred construction, one or more, preferably all, of the disks of the disk arrangement have an elastic element. For this purpose, for example, a preferably substantially disk-shaped elastic element, e.g., made of a plastic such as polystyrene, sealing materials, or another viscoelastic material, particularly rubber, can be fastened to a metal layer of the disk, preferably so as not to be detachable; for example, it can be glued to it, vulcanized on, or sprayed on. In a particularly preferred manner, a disk-shaped elastic element is sandwiched between two metal layers, respectively.

Due to the metal layers, which are preferably thin, and the elastic element, the disks are flexurally resilient and accordingly decouple the pipes relative to the housing. Further, a vibration-damping element at the disks dissipates vibration energy in pipes suspended at the disks and vibration energy in the fluid impinging on the disks.

In addition or alternatively, elastic elements, preferably elastic vibration-damping elements, can also be arranged between one or more, preferably all, of the disks and the pipe arrangement.

In a preferred construction, the pipe arrangement is fastened to the disk arrangement by frictional engagement in that, for example, pipes of the pipe arrangement are inserted in bore holes or fitted in or to sleeves which are formed in disks or fastened to the latter, respectively. Elastic, preferably vibration-damping elements made, e.g., from plastic, rubber or other viscoelastic materials can then be arranged in the region of contact between the pipe and disk. Further, assembly and disassembly of the muffler can be simplified by means of a frictionally engaging clamping connection of this kind.

One or more, preferably all, of the pipes of the pipe arrangement preferably have openings transverse to a through-flow direction. For this purpose, pipes can be produced, for example, from perforated sheet metal, wire mesh, or the like. The fluid flowing through these openings reduces vibrations; additionally, the thermodynamic characteristics and weight of the muffler are improved.

Damping material, for example, mineral wool, can also be arranged between pipes of the pipe arrangement, but also inside individual pipes in order to further damp vibrations in the fluid.

The selected diameter of the pipes is preferably small enough that transverse modes in the muffler can be reduced. To this end, the product of diameter, particularly hydraulic diameter, D of the pipe, pi π, and the emission frequency $f_A$ of the turbo engine or piston engine is advantageously at most twice, particularly at most 1.8-times, the sound velocity c of the fluid of the turbo engine or piston engine, so that:

$$D < \frac{1.8 \cdot c}{f_A \cdot \pi}.$$

In a preferred embodiment, a plurality of pipes, particularly at least three pipes, which are distributed, preferably equidistant from one another, along the circumference of the housing are received in the latter so that a sufficient total cross section of the muffler is realized at the same time.

According to a second aspect of the present invention which can preferably be combined with the first aspect described above, the housing is entirely or partially covered on its outer side with a vibration-damping jacket of dimensionally stable material. On the one hand, this jacket, due to its mass, shifts resonant frequencies of the muffler and amplitude peaks in the frequency response thereof; on the other hand, it damps higher-frequency oscillations in particular. In contrast to sand jackets, the dimensionally stable material improves contact and, therefore, vibration coupling with the housing. Further, it has been shown that dimensionally stable material has better damping properties.

Another advantage of dimensionally stable material consists in that—in contrast to sand—it can be more easily arranged at the housing. For this purpose, it can preferably be applied to the housing in liquid or viscous state, e.g., by spraying it on or by immersing the housing in a bath of dimensionally stable material which then solidifies on the housing, for example, hardens by itself, by supplying heat, by reacting with air, or by adding crosslinking agents.

The dimensionally stable material is preferably adhesive, i.e., adheres to other surfaces. This further improves contact and, therefore, vibration coupling with the housing and also facilitates fastening to the housing.

Fiber cement mortar or plastic, particularly polyurethane, has proven to be particularly suitable as a dimensionally stable and adhesive material which has good damping properties and is easy to use at the same time.

BRIEF DESCRIPTION OF THE DRAWINGS

Further advantages and features are described below with reference to the drawing in which:

FIG. 1 depicts the top half of a muffler according to an embodiment of the present invention, in longitudinal section.

DETAILED DESCRIPTION OF THE PRESENTLY PREFERRED EMBODIMENTS

FIG. 1 shows the top half of a muffler according to an embodiment of the present invention in longitudinal section. It comprises a three-part housing having a front housing part 1.1 upstream in the through-flow direction, a middle part 1.2 which is screwed to the latter by flanges, as is indicated in FIG. 1 by dash-dot lines, and a downstream, rear housing part 1.3 which is formed substantially symmetrically with respect to the front housing part 1.1 and is likewise screwed to the middle part 1.2 by flanges.

A disk 3 and 4, respectively, of a disk arrangement is clamped in frictional engagement between the flanges of the front housing part 1.1 and middle part 1.2 and between the middle part 1.2 and the rear housing part 1.3, respectively. These disks are formed of three parts and comprise in each instance an elastic disk 3.3 and 4.3, respectively, which is sandwiched between metal layers 3.1, 3.2 and 4.1, 4.2, respectively, and connected to the latter. The elastic disks 3.3, 4.3 are made of polystyrene and are glued to the metal layers 3.1, 3.2 and 4.1, 4.2, respectively.

The disks 3, 4 have three bore holes which are uniformly distributed along the inner circumference of the housing, and sleeves 3.4 and 4.4, respectively, extend through these bore holes. These sleeves have a shoulder at their inner circumference and are welded to the disks 3 and 4, respectively, on their outer circumference, which is indicated by solid triangles in FIG. 1 as is customary in the art.

Another, one-piece disk 5 is welded approximately in the middle of the housing 1. This one-piece disk 5 has bore holes which are aligned with the bore holes in disks 3, 4 and in which are likewise inserted sleeves 5.1 which have a central, inwardly projecting shoulder at their inner circumference and which are welded to the disk 5. This disk increases the stiffness of the muffler and, in particular, counteracts vibrations.

Three parallel pairs of pipes which are aligned with one another, of which only one pair 2.1, 2.2 is shown in the top longitudinal section of FIG. 1, are inserted by their front sides in sleeves 3.4, 5.1 and 5.1, 4.4, respectively, in frictional engagement and are held by the latter so as to be clamped in the housing 1, which advantageously also makes it possible to compensate for different, e.g., temperature-dependent, changes in length of the housing 1 and pipes 2. A viscoelastic element in the form of a rubber ring or plastic ring 6, 7 and 8, respectively, is arranged between the inner circumference of the sleeve and the outer circumference of the pipe. The pipes 2.1, 2.2 are made from perforated sheet metal.

A dimensionally stable jacket 9 of fiber cement mortar or polyurethane is arranged on substantially the entire outer circumferential surface of the middle part 1.2.

The muffler is capable of damping pressure pulsations in the fluid which are conveyed into the muffler, for example, by a screw compressor (not shown) and is further capable of efficiently reducing the transfer and emission of structure borne sound:

- pressure pulsations in the fluid are damped by the flow through the perforated pipes 2.1, 2.2;
- by suspending viscoelastic middle layers 3.3, 4.3 at disks 3, 4 in the housing 1 and by means of the frictionally engaging fastening by viscoelastic sleeves 6, 7, 8 to the disks 3, 4 and 5, the pipes 2.1, 2.2 are substantially decoupled from the housing 1 with respect to vibrations, and transferred vibrations, particularly structure-borne sound, are dissipated additionally by the deformation work of the viscoelastic elements 3.3, 4.3, 6, 7 and 8;

the disks 3, 4, which act in this respect as acoustically dead plates, damp vibrations in the fluid; and the dimensionally stable jacket 9 additionally damps vibrations in the housing 1.

The steps mentioned above cooperate in an advantageous manner. At the same time, an advantageous sound reduction can be achieved by even one of these steps. For example, in a modification not shown in the drawing, the pipes 2.1, 2.2 can be inserted into the sleeves 3.4, 4.4 and 5.1, respectively, directly, i.e., without the intermediary of viscoelastic sleeves 6 to 8, which can advantageously improve the endurance strength of the muffler and facilitate assembly and disassembly. Additionally or alternatively, the jacket 9 of dimensionally stable material can be dispensed with or can be used in a muffler, known in other respects, without vibration-decoupled inner pipes.

REFERENCE NUMERALS

1.1-1.3 housing parts
3 disk
3.1, 3.2 metal layer
3.3 elastic element
3.4 sleeve
4 disk
4.1, 4.2 metal layer
4.3 elastic element
4.4 sleeve
5 disk
5.1 sleeve
6-8 elastic element
9 jacket

The invention claimed is:

1. A muffler for a turbo engine or piston engine, particularly a screw compressor, said muffler comprising: a housing (1.1-1.3) including at least a first and second housing part (1.1-1.2), a flange section radially extending from each of said first and said second housing part, said flange sections opposing each other; a disk arrangement including at least one disk (3, 4) fastened between said opposing flange sections; a pipe arrangement fastened to said disk arrangement and having at least one pipe (2.1, 2.2) for guiding a fluid of the turbo engine or piston engine; and an elastic element (3.3, 4.3, 6, 7, 8) as a separate part from the disc arrangement and interposed between said pipe arrangement and said opposing flange sections, said elastic element being constructed to damp vibrations for at least partially decoupling said pipe arrangement from said housing with respect to vibration.

2. The muffler according to claim 1, wherein said at least one disk (3, 4) of said disk arrangement comprises said elastic element (3.3, 4.3).

3. The muffler according to claim 2, wherein said at least one disk (3, 4) of said disk arrangement comprises at least one metal layer (3.1, 3.2, 4.1, 4.2) and said elastic element (3.3, 4.3) fastened to said metal layer.

4. The muffler according to claim 1, wherein said at least one elastic element (6, 7, 8) is arranged between said disk arrangement and said pipe arrangement.

5. The muffler according to claim 1, wherein said pipe arrangement is fastened to said disk arrangement by frictional engagement.

6. The muffler according to claim 5, wherein said disk arrangement comprises a sleeve (3.4, 4.4, 5.1) for receiving a pipe (2.1, 2.2) of said pipe arrangement in frictional engagement.

7. The muffler according to claim 1, wherein said pipe of said pipe arrangement has openings transverse to a through-flow direction.

8. The muffler according to claim 1, additionally comprising damping material arranged one of at the inside and outside of said pipe arrangement.

9. The muffler according to claim 1, wherein a product of a circumference ($D\pi$) of a pipe of said pipe arrangement and an emission frequency ($f_A$) of the turbo machine or piston machine is at most twice the sound velocity (c) of the fluid of the turbo machine or piston machine.

10. The muffler according to claim 1, wherein a product of a circumference ($D\pi$) of a pipe of said pipe arrangement and an emission frequency ($f_A$) of the turbo machine or piston machine is at least 1.8 times the sound velocity (c) of the fluid of the turbo machine or piston machine.

11. The muffler of claim 1, additionally comprising a vibration-damping jacket (9) of dimensionally stable material at least partially covering an outer side of said housing (2.2).

12. The muffler according to claim 11, wherein said dimensionally stable material comprises one of fiber cement mortar and plastic.

13. The muffler of claim 11, wherein said dimensionally stable material is applied to said housing in liquid state and solidifies on the housing.

* * * * *